US008146521B2

(12) United States Patent
Nakamura et al.

(10) Patent No.: US 8,146,521 B2
(45) Date of Patent: Apr. 3, 2012

(54) SEWING MACHINE AND COMPUTER-READABLE RECORDING MEDIUM WITH RECORDED SEWING MACHINE CONTROL PROGRAM

(75) Inventors: Yoshinori Nakamura, Toyohashi (JP); Hirokazu Hirose, Chiryu (JP); Yoshio Nishimura, Nagoya (JP); Akie Ukai, Nagoya (JP); Satoru Makino, Nagoya (JP); Masaki Shimizu, Toyoake (JP); Kazumi Sai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1049 days.

(21) Appl. No.: 12/076,627

(22) Filed: Mar. 20, 2008

(65) Prior Publication Data

US 2008/0229992 A1 Sep. 25, 2008

(30) Foreign Application Priority Data

Mar. 22, 2007 (JP) ..... 2007-073843

(51) Int. Cl.
*D05B 21/00* (2006.01)

(52) U.S. Cl. ..... 112/102.5

(58) Field of Classification Search ..... 112/470.12, 112/470.02, 470.03, 475.05, 102.5, 102, 112/272; 700/136, 137, 138
See application file for complete search history.

(56) References Cited

U.S. PATENT DOCUMENTS

| | | | | |
|---|---|---|---|---|
| 4,275,674 | A * | 6/1981 | Carbonato et al. | 112/445 |
| 4,892,050 | A * | 1/1990 | Ando et al. | 112/458 |
| 7,620,472 | B2 * | 11/2009 | Hamajima | 700/136 |
| 7,806,063 | B2 * | 10/2010 | Shimizu | 112/278 |

FOREIGN PATENT DOCUMENTS

| | | |
|---|---|---|
| JP | A-56-102276 | 8/1981 |
| JP | U-4-64376 | 6/1992 |
| JP | A-2002-292175 | 10/2002 |

OTHER PUBLICATIONS

U.S. Appl. No. 11/902,901, filed Sep. 26, 2007, Eiichi, Hamajima.

* cited by examiner

*Primary Examiner* — Tejash Patel
(74) *Attorney, Agent, or Firm* — Oliff & Berridge, PLC

(57) ABSTRACT

A sewing machine that enables a user to perform sewing while moving a piece of work cloth, the sewing machine including: a main shaft that drives a needle bar equipped with a sewing needle, a sewing machine motor that rotary-drives the main shaft, a detection device that detects an actual movement distance of the piece of work cloth, a target pitch storage device that stores a predetermined length as a target pitch, which is a target value of stitch pitches of the piece of work cloth, an agreement degree calculation device that calculates an agreement degree between the target pitch and a stitch pitch in actual sewing that is to be determined based on the actual movement distance of the piece of work cloth which is detected by the detection device; and a notification device that notifies of the agreement degree calculated by the agreement degree calculation device.

30 Claims, 14 Drawing Sheets

SEWING MACHINE AND COMPUTER-READABLE RECORDING MEDIUM WITH RECORDED SEWING MACHINE CONTROL PROGRAM

CROSS REFERENCE TO RELATED APPLICATION

The present application claims priority to Japanese Patent Application No. 2007-073843, filed on Mar. 22, 2007, the disclosure of which is herein incorporated by reference in its entirety.

BACKGROUND

The present disclosure relates generally to a sewing machine and a computer-readable recording medium recorded a sewing machine control program. More specifically, the disclosure relates to a sewing machine that enables a user to perform sewing while moving a piece of work cloth and a computer-readable recording medium recorded with a sewing machine control program.

In the related art, free motion sewing has been performed by a user that forms stitches by carrying out sewing while moving a piece of work cloth by hand. Such free motion sewing has been employed in quilting-sewing, in which for example, an interlining cotton is placed between an outer material and a lining material and a stitch pattern, such as a straight line or a curve is sewn. In such free motion sewing, there are several requirements to obtain beautiful sewing results. One of the requirements is that the stitch lengths (pitches) should be uniform. However, to provide uniform stitch lengths in sewing, it is necessary for a sewing operator to be highly skilled. To this end, a sewing machine described in Japanese Patent Application Laid-Open Publication No. 2002-292175 reads a movement distance of a piece of work cloth for each stitch and changes a sewing speed corresponding to this movement distance of the piece of work cloth.

Another sewing machine has been proposed (see, for example, Japanese Patent Application Laid Open Publication No. SHO 56-102276), which is equipped with a speed setting apparatus that sets a sewing speed so that a speed indication lamp may illuminate corresponding to a speed set by the speed setting apparatus. A further sewing machine has been proposed (see, for example, Japanese Utility Model Application No. HEI 4-64376), which is equipped with a speed setting switch so that a light emitting diode (LED) may illuminate corresponding to a speed set by the speed setting switch.

SUMMARY

However, the sewing machine described in Japanese Patent Application Laid-Open Publication No. 2002-292175 only creates uniform pitches by varying a sewing speed corresponding to a movement distance of a piece of work cloth, so that, if the sewing speed is constant, the user cannot know how much the piece of work cloth should be moved in order to create uniform pitches. The sewing machines described, respectively, in Japanese Patent Application Laid-Open Publication No. SHO 56-102276 and Japanese Utility Model Application No. HEI 4-64376 only display a speed that has been set. Therefore, those sewing machines have a problem that if sewing is performed at a constant speed, the user cannot know how much the piece of work cloth should be moved in order to create uniform pitches.

In order to solve these problems, the present disclosure has been developed, and an object of the present disclosure is to provide a sewing machine that helps a user to obtain a sewing result of uniform pitches.

According to a first aspect of the present disclosure, there is provided a sewing machine that enables a user to perform sewing while moving a piece of work cloth, the sewing machine includes: a main shaft that drives a needle bar that is equipped with a sewing needle, a sewing machine motor that rotary-drives the main shaft, a detection device that detects an actual movement distance of the piece of work cloth, a target pitch storage device that stores a predetermined length as a target pitch, which is a target value of the stitch pitches of the piece of work cloth, an agreement degree calculation device that calculates an agreement degree between the target pitch and an actual stitch pitch in sewing that is determined based on the actual movement distance of the piece of work cloth which is detected by the detection device, and a notification device that notifies of the agreement degree calculated by the agreement degree calculation device.

According to a second aspect of the present disclosure, there is provided a computer-readable recording medium storing a sewing machine control program that controls a sewing machine that enables a user to perform sewing while moving a piece of work cloth, the program including: a detection instruction for detecting an actual movement distance of the piece of work cloth, a target pitch storage instruction for storing a predetermined length as a target pitch, which is a target value of the stitch pitches of the piece of work cloth, an agreement degree calculation instruction for calculating an agreement degree between the target pitch and an actual stitch pitch in sewing that is determined based on the actual movement distance of the piece of work cloth which is detected by the detection instruction, and a notification instruction for notifying of the agreement degree calculated by the agreement degree calculation instruction.

BRIEF DESCRIPTION OF THE DRAWINGS

Exemplary examples of the invention will be described below in detail with reference to the accompanying drawings in which.

DETAILED DESCRIPTION

The following will describe a examples of the present disclosure with reference to the drawings. Because sewing machines 1 of the respective first through third examples have the same physical and electrical configurations, the physical and electrical configurations of the sewing machine 1 will be described below with reference to FIGS. 1 to 4.

Figure 1:
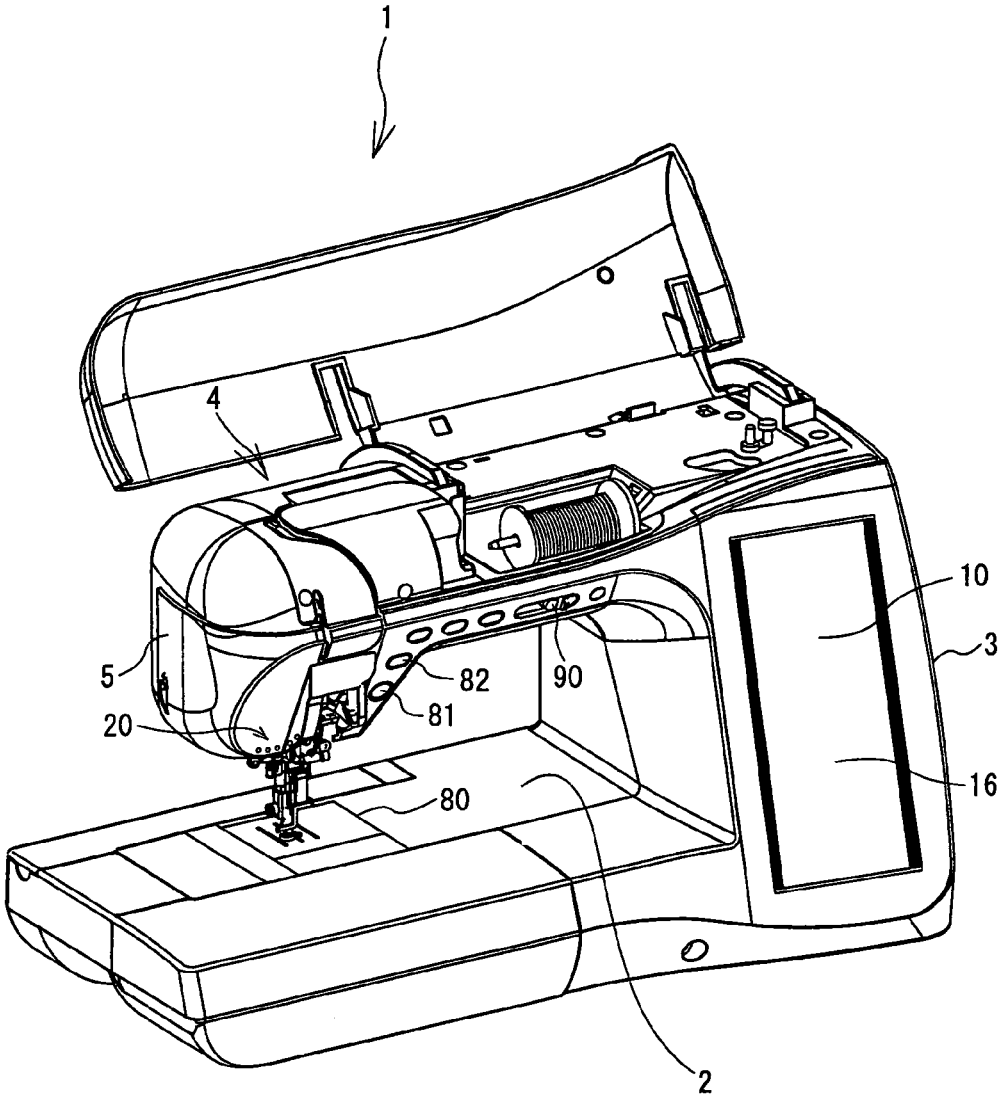
FIG. 1 is a perspective view of a sewing machine as viewed from above.

First, the physical configuration of the sewing machine 1 will be described below with reference to FIG. 1. The sewing machine 1 has a sewing machine bed 2 that is longer in the right and left direction, a pillar 3, an arm portion 4, and a head portion 5. The pillar 3 is erected upward at the right end of the sewing machine bed 2. The arm portion 4 extends leftward from the upper end of the pillar 3. The head portion 5 is provided to the left tip of the arm portion 4. The pillar 3 is fitted on its front surface a liquid crystal display (LCD) 10 equipped with a touch panel on its surface. The LCD 10 includes entry keys and the like, for entering a pattern to be sewn and the sewing conditions. The user can select a pattern to be sewn, the sewing conditions and the like, by touching the positions corresponding to those entry keys etc., on the touch panel 16. The sewing machine 1 includes in it a sewing machine motor 79 (see FIG. 4), a main shaft, a needle bar 6 (see FIG. 3), a needle bar up-and-down movement mechanism (not shown), a needle bar swinging mechanism (not shown), a needle bar releasing mechanism (not shown), and the like. The needle bar 6 is fitted with a sewing needle 7 at its lower end. The needle bar up-and-down movement mechanism 22 may move the needle bar 6 up and down. The needle bar swinging mechanism may swing the needle bar 6 in the right and left direction. The needle bar releasing mechanism may release the needle bar 6 from the force of the sewing machine motor 79.

The sewing machine bed 2 has a needle plate 80 disposed on its upper surface. The sewing machine bed 2 includes a feed dog back-and-forth movement mechanism (not shown), a feed dog up-and-down movement mechanism (not shown), a feed adjustment pulse motor 78 (see FIG. 4), a shuttle (not shown), and the like. The feed dog back-and-forth movement mechanism and the feed dog up-and-down movement mechanism may drive a feed dog. The feed adjustment pulse motor 78 may adjust a feed distance by which a piece of work cloth is fed using the feed dog. The shuttle houses a bobbin thread.

Figure 2:
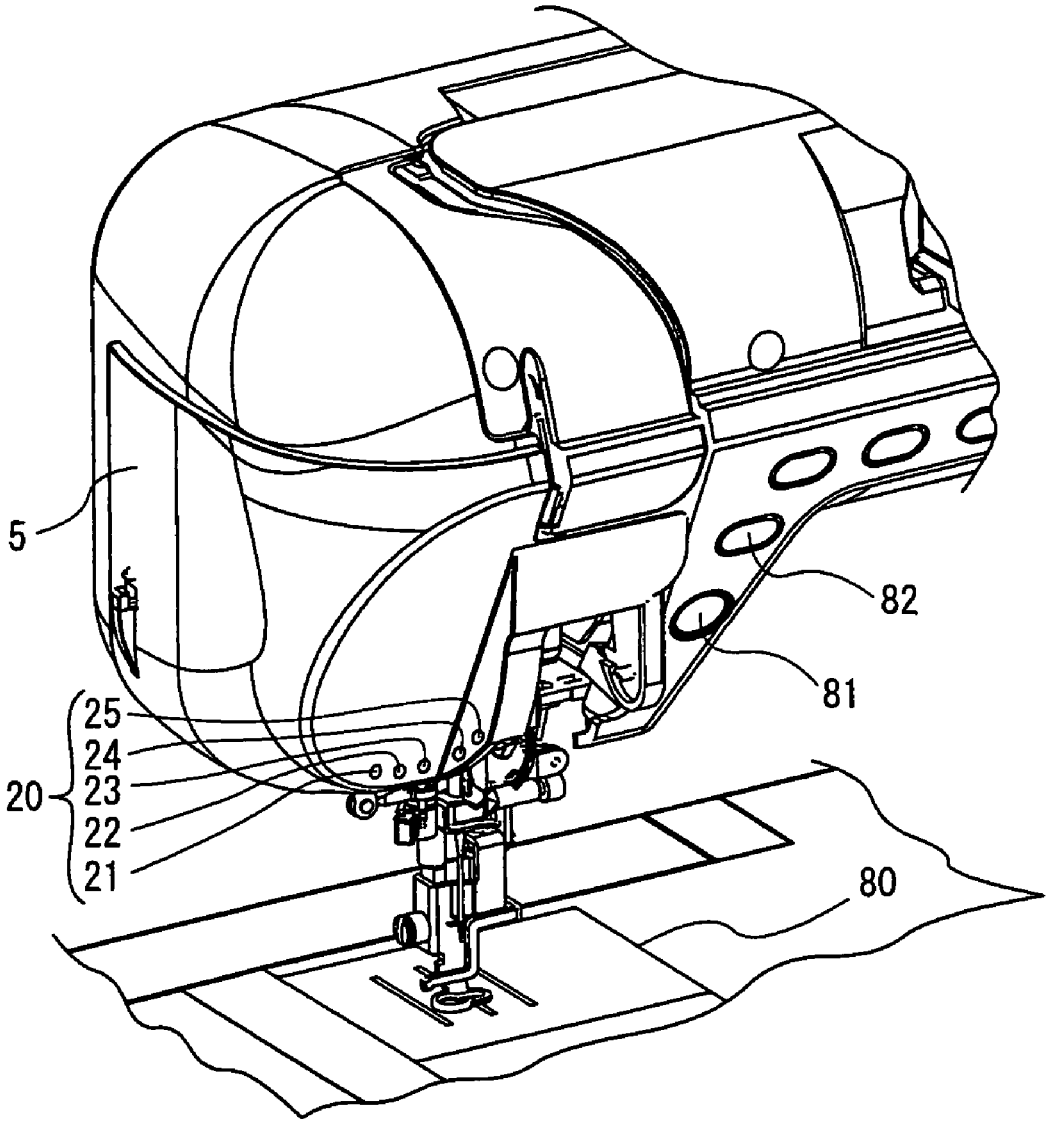
FIG. 2 is a partially enlarged view showing an agreement degree notification LED fitted to the top of the sewing machine.

The sewing machine 1 may be equipped on its right surface a pulley (not shown) such that the main shaft is revolved by hand to move the needle bar 6 up and down. On the right side of the front surface of the head portion 5 are equipped a sewing start switch 81, a sewing stop switch 82, and a sewing speed adjustment switch 90. The sewing start switch 81 may be used to start sewing by starting the driving of the sewing machine motor 79. The sewing stop switch 82 may be used to stop sewing by stopping the driving of the sewing machine motor 79. The sewing speed adjustment switch 90 may be used to adjust a sewing speed (revolving speed of the main shaft). Further, on the left side on the front surface of the head portion 5, an agreement degree notification LED 20 may be equipped. As shown in FIG. 2, the agreement degree notification LED 20 may include five LEDs, LEDs 21 to 25, and may be used to notify the degree of agreement between a target pitch and a pitch of the actual stitches formed in sewing. The LEDs 21 to 25 are sequentially disposed in order of LED 21, LED 22, LED 23, LED 24, and LED 25 from left to right. The LED 23, which is in the middle, when illuminated, shows the best degree of agreement with a target pitch. The more leftwards the illuminated LED is, the shorter than the target pitch the pitches to be created are, and the more rightwards the illuminated LED is, the larger than the target pitch the pitches to be created are. In other words, the agreement degree notification LEDs of 20 s that indicate a distance by which the piece of cloth is moved when sewing, are disposed in order of LED 21, LED 22, LED 23, LED 24, and LED 25 from left to right.

Figure 3:
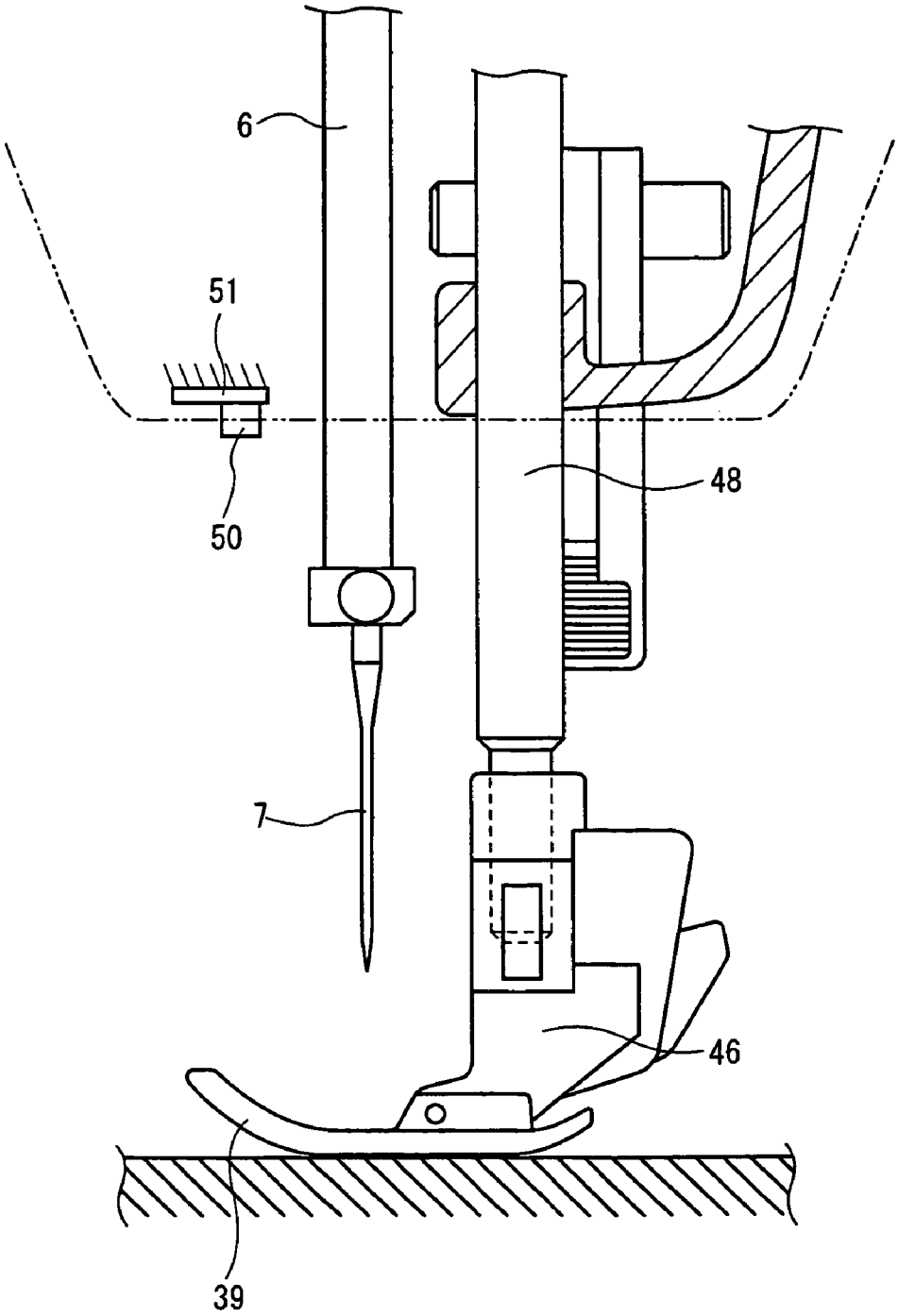
FIG. 3 is a schematic diagram showing an image sensor.

Next, an image sensor 50 will be described below with reference to FIG. 3. The image sensor 50 is a known displacement sensor. The image sensor 50 may be equipped with a CCD camera and a control circuit, thereby picking up an image with the CCD camera. The image sensor 50 compares the same portions of an image picked up previously and an image picked up currently and then provides numerals (X-Y coordinate values) that indicate a range of the same portions and in which direction and how far a shooting target has moved from a position in the image. In the example, as shown in FIG. 3, a frame (not shown) of the sewing machine 1 is fitted with a support frame 51. This support frame 51 may be fitted with the image sensor 50 in such a manner that the image sensor 50 can photograph the needle drop point of the sewing needle 7 and the positions in the vicinity thereof. It should be noted that a needle drop point refers to a point at which the sewing needle 7 is moved downward by the needle bar up-and-down movement mechanism and the piece of work cloth that it enters into. A presser foot 39 which holds down the piece of work cloth may be attached to a presser holder 46 which may be fixed to the lower end of the presser bar 48. The presser foot 39 and the presser holder 46 are made of a transparent resin so that the needle drop point and the positions in the vicinity thereof can be photographed. Further, the CCD camera may be a CMOS camera or any other image pickup device.

Figure 4:
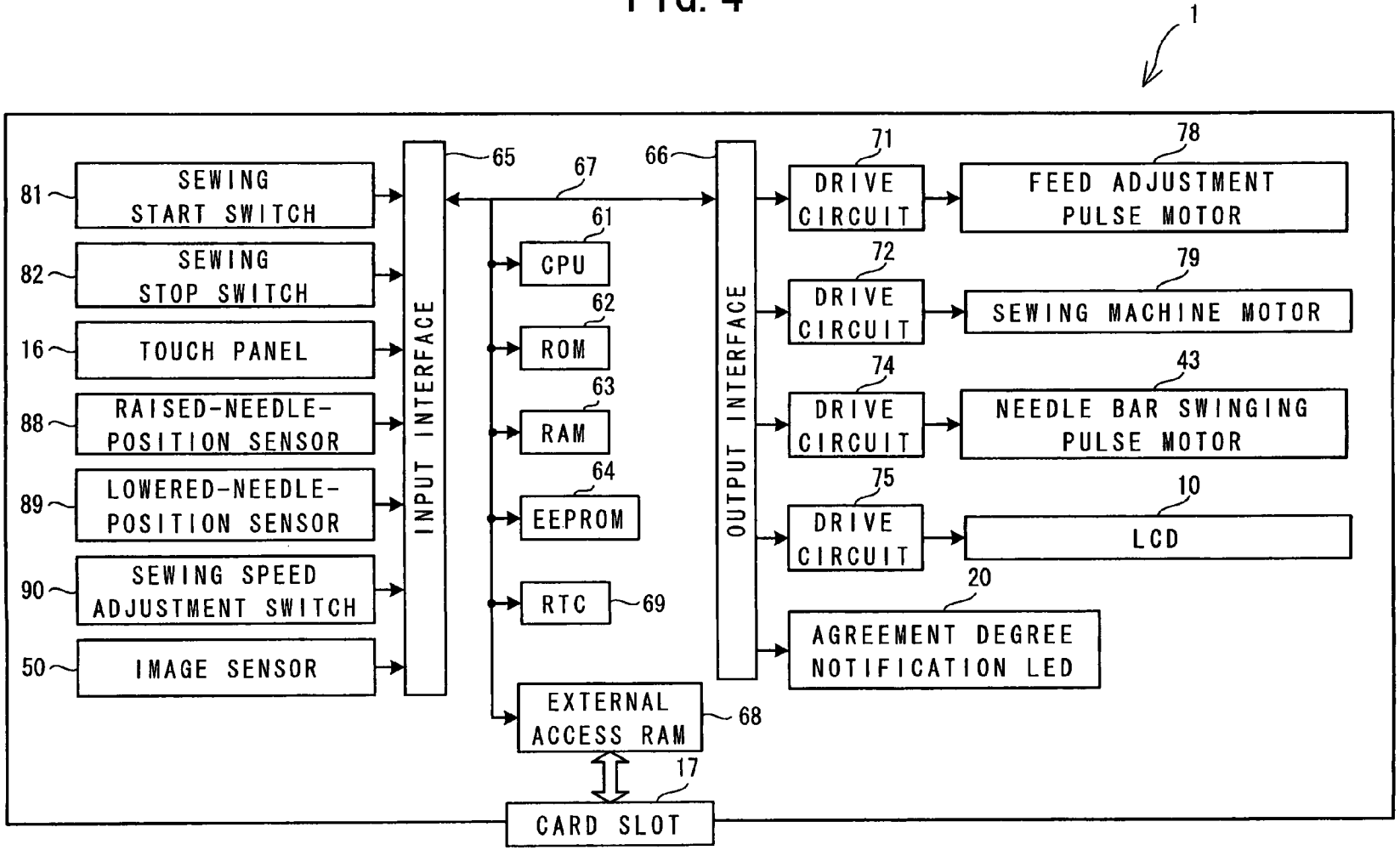
FIG. 4 is a block diagram showing an electrical configuration of the sewing machine.

Next, the electrical configuration of the sewing machine 1 will be described below with reference to FIG. 4. As shown in FIG. 4, the sewing machine 1 may include a CPU 61, a ROM 62, a RAM 63, an EEPROM 64, a card slot 17, an external access RAM 68, an input interface 65, an output interface 66, and an RTC 69, and the like. These elements may be connected to each other via a bus 67. Connected to the input interface 65 are the sewing start switch 81, the sewing stop switch 82, the touch panel 16, a raised-needle-position sensor 88, a lowered-needle-position sensor 89, the sewing speed adjustment switch 90, the image sensor 50, and the like. On the other hand, electrically connected to the output interface 66 are drive circuits 71, 72, 74 and 75, and the agreement degree notification LED 20. The drive circuit 71 drives the feed adjustment pulse motor 78. The drive circuit 72 drives the sewing machine motor 79, which may be used to rotary-drive the main shaft. The drive circuit 74 drives a needle bar swinging pulse motor 43, which may be used to drive the needle bar 6 by oscillating it. The drive circuit 75 drives the LCD 10.

The CPU 61 conducts main control over the sewing machine 1 and performs a variety of operations and processing in accordance with a control program stored in a control program storage region of the ROM 62, which may be a read only memory. The RAM 63, which may be a random access memory, has various storage regions as required for storing results of operations performed by the CPU 61. The sewing start switch 81 and the sewing stop switch 82 may be of a button type. The raised-needle-position sensor 88 may be operative to detect the rotation phase of the main shaft and it is set to output an ON signal when the main shaft revolves until the tip of the sewing needle 7 reaches a position (raised needle position) higher than the upper surface of the needle plate 80. The lowered-needle-position sensor 89 may be operative to detect the rotation phase of the main shaft and set to provide the ON signal when the main shaft revolves until the needle bar is lowered from the raised needle position down to a position (lowered needle position) where the tip of the sewing needle 7 is lower than the upper surface of the needle plate 80. The sewing speed adjustment switch 90 may be of a slide type and can give instructions of a sewing speed, that is, the revolving speed of the main shaft. In the sewing machine 1 in the first example, as the slide knob is moved leftward, the speed is lowered, and as it is moved rightward, the speed is raised.

Figure 5:
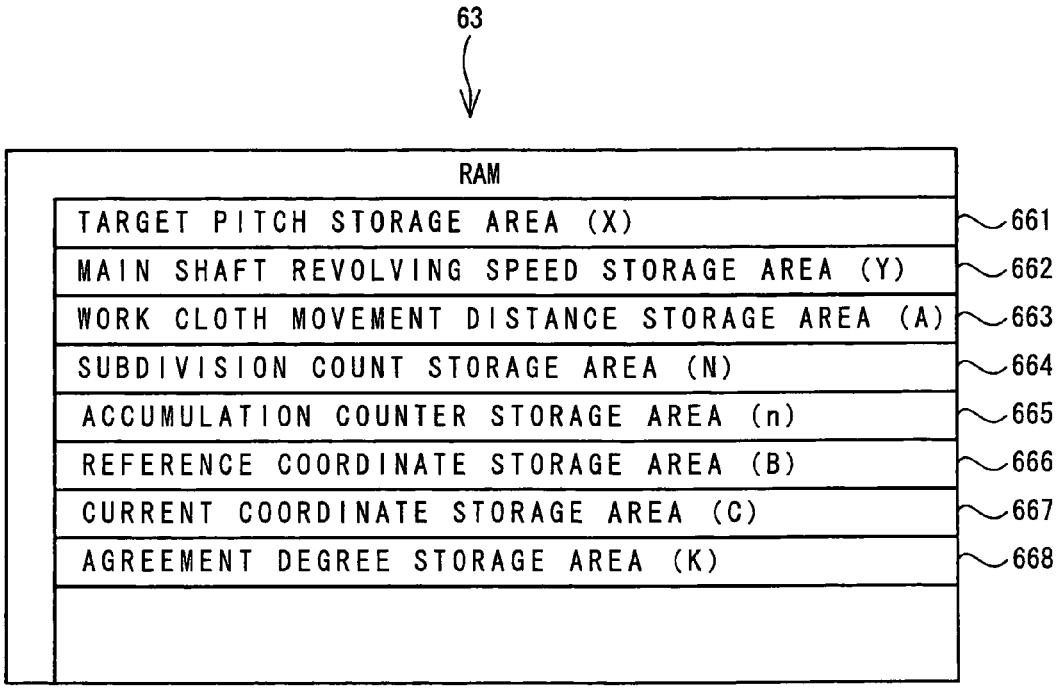
FIG. 5 is a conceptual diagram showing storage areas of a RAM.

Next, the first example will be described below with reference to FIGS. 5 to 7.

First, the storage areas of the RAM 63 will be described below with reference to FIG. 5. As shown in FIG. 5, the RAM 63 has a target pitch storage area 661, a main shaft revolving speed storage area 662, a work cloth movement distance storage area 663, a subdivision count storage area 664, an accumulation counter storage area 665, a reference coordinate storage area 666, a current coordinate storage area 667, an agreement degree storage area 668, and the like. It should be noted that the RAM 63 may also have other storage areas that are not shown.

The target pitch storage area 661 stores a pitch (stitch length) that is targeted in sewing. The target pitch X may be inputted by the user as a numeral prior to start of sewing or selected from values registered beforehand and stored in the target pitch storage area 661. The target pitch X may be inputted on an entry and selection screen shown on the LCD 10 and accepted by using the touch panel 16. The main shaft revolving speed storage area 662 stores the main shaft revolving speed Y, which is specified with the sewing speed adjustment switch 90 in an initial routine upon activation of the sewing machine 1. It should be noted that the main shaft revolving speed Y is given as the number of times of revolving of the main shaft per minute. In the sewing machine 1 in the first example, the main shaft revolving speed Y is supposed to be 70-850 rpm. It should be noted that each time the sewing speed adjustment switch 90 is operated, the speed is changed to the specified main shaft revolving speed. The work cloth movement distance storage area 663 stores a work cloth movement distance A, which is outputted from the image sensor 50. The work cloth movement distance A is outputted as an X-Y coordinate value and supposed to be expressed as a work cloth movement distance A (XA, YA).

The subdivision count storage area 664 stores a subdivision count N. which may be used to calculate an agreement degree K. The subdivision count N is a numeral that indicates the number of unitary lapse of times T that are present in a period of time during which the piece of work cloth can be moved, that is, a lapse of time that the sewing needle 7 takes to reach its raised needle position at a preset sewing speed. It should be noted that a work cloth movement-enabled period of time Q can be considered to be roughly a half of a period of time that the main shaft takes for one revolution. Therefore, it is calculated as "work cloth movement-enabled period of time Q=(60/main shaft revolving speed Y)/2". In the sewing machine 1 in the first example, because the main shaft revolving speed Y is 70-850/min., a relationship may be established that "$(60/850)/2 \leqq$ work cloth movement-enabled period of time $Q \leqq (60/70)/2$". More simply, it may be given as "$0.035 <$ work cloth movement-enabled period of time $Q < 0.43$". Because an unitary lapse of time T is set smaller than the work cloth movement-enabled period of time Q, the unitary lapse of time T may be set to 0.01, 0.02, etc.

The accumulation counter storage area 665 stores an accumulation counter n, which may be operative to count the unitary lapse of times that have elapsed while the sewing needle 7 remains at the raised needle position. The reference coordinate storage area 666 stores, as a reference coordinate, information (X-Y coordinate) that indicates a needle drop point at a point in time when the sewing needle 7 has reached the raised needle position from the lowered needle position. The current coordinate storage area 667 stores, as a current coordinate, information (X-Y coordinate) that indicates a needle drop point at a time when the agreement degree K is determined.

The agreement degree storage area 668 stores the agreement degree K that indicates the degree of agreement between the target pitch X and the pitch of the stitches, which are actually formed in sewing. In the first example, a distance by which the piece of work cloth is moved is detected in each unitary lapse of time. When the formation of stitches starts, that is, from a point in time when the sewing needle 7 has reached the raised needle position from the lowered needle position, the movement distance detected in each unitary lapse of time is accumulated, thereby a distance movement of the piece of work cloth (actual movement distance) as accumulated from the point in time of the formation of the stitches is calculated. On the other hand, in order to give a target pitch, a target movement distance per unitary lapse of time that indicates a distance by which the piece of work cloth should be moved in the unitary lapse of time is calculated, to accumulate a target movement distance (target movement distance) in a lapse of time that has elapsed from a point in time of the formation of the stitches. Then, the actual movement distance and the target movement distance are compared with each other, thereby an agreement degree K is calculated. In the present first example, the ratio of an actual movement distance with respect to a target movement distance is referred to as an agreement degree K. That is, "agreement degree K=actual movement distance/target movement distance".

Next, the operations of the sewing machine 1 in the first example will be described below with reference to the flowcharts of FIGS. 6 and 7. A sewing routine is carried out when the sewing start switch 81 is pressed to cause the CPU 61 to execute a sewing program stored in the ROM 62.

First, the process performs an initial routine in step 1 (S1). In this initial routine, the process initializes the work cloth movement distance storage area 663, the subdivision count storage area 664, the accumulation counter storage area 665, the reference coordinate storage area 666, the current coordinate storage area 667, and the agreement degree storage area 668 of the RAM 63 so that they may store initial value "0". Subsequently, the process reads a target pitch X from the target pitch storage area 661 in step 2 (S2), and reads the main shaft revolving speed Y from the main shaft revolving speed storage area 662 of the RAM 63 in step 3 (S3). Next, the process calculates a subdivision count N by dividing a work cloth movement-enabled period of time Q by the unitary lapse of time T and stores it into the subdivision count storage area 664 in step 4 (S4). As described above, the work cloth movement-enabled period of time Q may be determined by the main shaft revolving speed Y. Further, the unitary lapse of time T may be determined beforehand. Here, the unitary lapse of time is set to 0.01 s, for example. Therefore, for example, if the main shaft revolving speed Y is "600 rpm", "subdivision count $N=(60/600)/0.01=10$". It should be noted that if the value is not indivisible, only the integral part of the quotient is taken as the subdivision count N.

Then, the sewing machine motor 79 starts revolution in step 5 (S5). In step 6 (S6), the process waits until the sewing needle 7 reaches its raised needle position (NO at S6→S6). Specifically, the process determines whether the sewing needle 7 is at the raised needle position based on the output of the raised-needle-position sensor 88 (S6). If it is determined that the sewing needle 7 is not at the raised needle position (NO at S6), the process repeats determination of the output of the raised-needle-position sensor 88 (S6).

If it is determined that the sewing needle 7 has reached the raised needle position (YES at S6), it means that the sewing needle 7 is pulled out of the piece of work cloth to start the formation of stitches. Therefore, the process accesses the image sensor 50 to acquire a work cloth movement distance A (XA, YA) and stores it in the work cloth movement distance storage area 663 in step 7 (S7). It should be noted that when the image sensor 50 is accessed for the first time after the start of sewing, (0, 0) is outputted as the work cloth movement distance A. Then, the process calculates a reference coordinate B (XB, YB) indicative of a position where the formation of the stitches is started and stores it in the reference coordinate storage area 666 in step 8 (S8). This reference coordinate B is calculated by adding a movement distance acquired at S8 to a coordinate (to which a current coordinate C corresponds) at the time of the previous access to the image sensor 50. It should be noted that when the reference coordinate B is calculated first after sewing is started, the work cloth movement distance A is (0, 0) and the current coordinate C is initial value (0, 0), and thus the reference coordinate B takes on the value (0, 0). That is, an original point is set to the position of the piece of work cloth at a point in time when the image sensor 50 is accessed for the first time after sewing is started. Subsequently, the process stores "0" in the accumulation counter n and the reference coordinate B in the current coordinate C (XC, YC) in step 9 (S9).

Then, in step 10 (S10), the process asks the RTC 69 for the current time and waits until a unitary lapse of time elapses (NO at S10→S10). If the unitary lapse of time T elapses (YES at S10), the process increments the accumulation counter n by "1" in step 111 (S11) and accesses the image sensor 50 to acquire a work cloth movement distance A (X-A, YA) and to store it in the work cloth movement distance storage area 663 in step 12 (S112). Then, the process calculates a current coordinate C and stores it in the current coordinate storage area 667 in step 13 (S13). Specifically, the process adds the work cloth movement distance A to the current coordinate C stored in the current coordinate storage area 667, which is the coordinate at a point in time when the image sensor 50 is accessed previously. In such a manner, a coordinate at a point in time when it is accessed currently may be calculated as the current coordinate value C.

Figure 7:
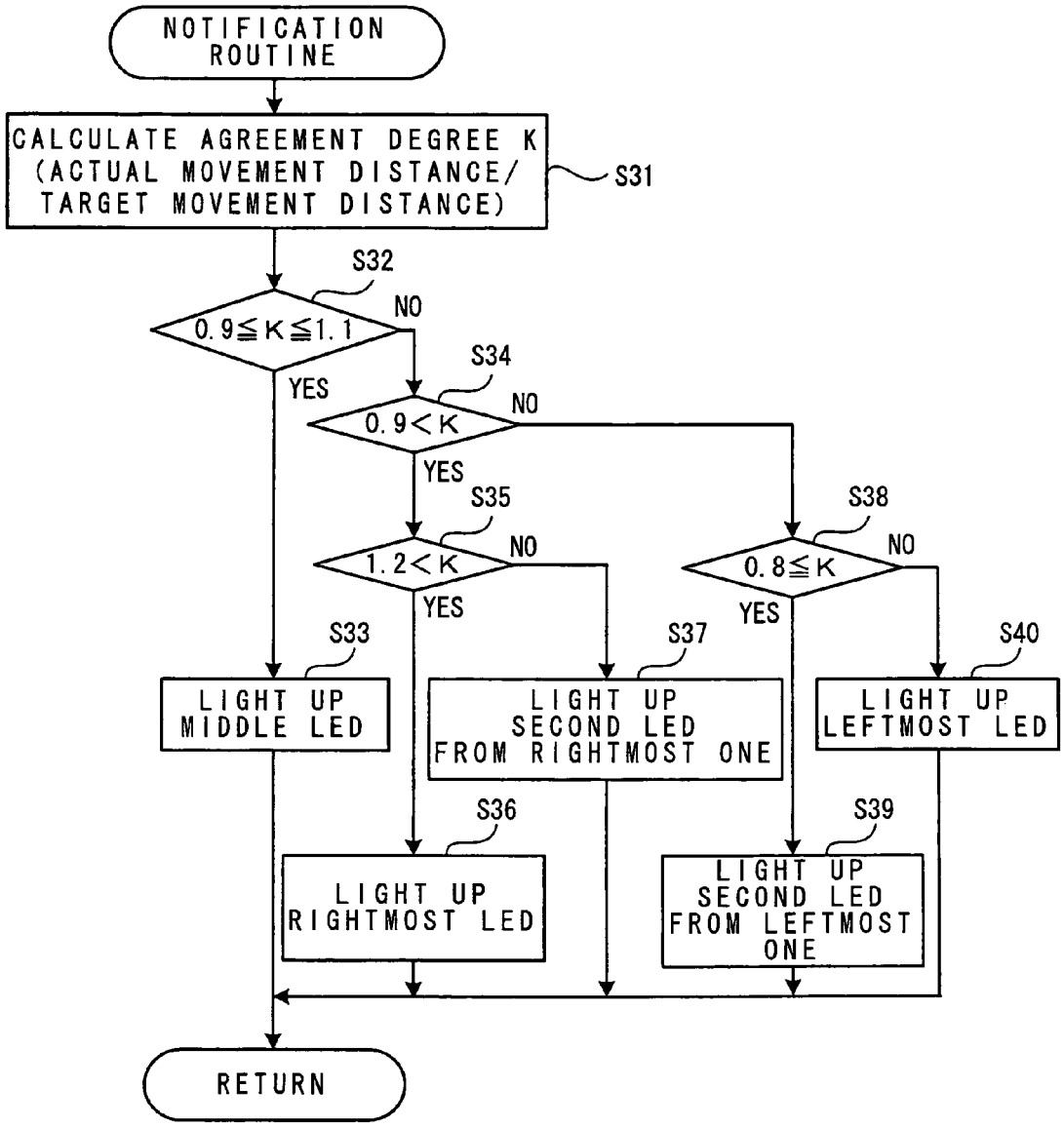
FIG. 7 is a flowchart of a notification routine that is performed in the sewing routine.

Then, in step 14 (S14), a notification routine is carried out (see S14 in FIG. 7). In this notification routine, the process calculates an agreement degree K and, based on it, illuminates the agreement degree notification LED 20. As shown in FIG. 7, the process first calculates the agreement degree K in step 31 (S31). This agreement degree K is calculated by calculating "actual movement distance/target movement distance". The actual movement distance refers to a distance from a starting point (reference coordinate B) of a stitch and a current needle drop point (current coordinate C), that is, the length of a line segment that interconnects the point of the reference coordinate B and that of the current coordinate C. Therefore, the actual movement distance is obtained as a positive square root of "$(XC-XB)^2+(YC-YB)^2$". On the other hand, the target movement distance is obtained as "(accumulation counter n/subdivision count N)*target pitch X". That is, the closer to 1.0 the agreement degree K is, the more the target pitch is approached and the smaller the difference therefrom. Further, the smaller the agreement degree K is, the less the target pitch is approached and the smaller the movement distance of the piece of work cloth is; and the larger the agreement degree K is, the more the target pitch is exceeded and the larger the movement distance of the piece of work cloth is.

In accordance with the value of the agreement degree K, the process performs processing to illuminate the agreement degree notification LED 20 in steps 32 to 40 (S32 to S40). First, the process determines whether the agreement degree K is in the range between 0.9 and 1.1 (S32). If it is in this range (YES at S32), it means that the difference from the target pitch is small, and thus the process illuminates only the middle LED 23 in step 33 (S33). That is, if "0.9≦agreement degree K≦1.1", only the middle LED 23 is illuminated. Then, the process returns to the sewing routine.

If the agreement degree K is not in the range between 0.9 and 1.1 (NO at S32), the process determines whether the agreement degree K is larger than 0.9 in step 34 (S34). If the agreement degree K is larger than 0.9 (YES at S34), the process further determines whether the agreement degree K is larger than 1.2 in step 35 (S35). If the agreement degree K is larger than 1.2 (YES at S35), the process illuminates only the rightmost LED 25 in step 36 (S36). That is, if "1.2<agreement degree K", the process illuminates only the rightmost LED 25. Then, the process returns to the sewing routine. On the other hand, if the agreement degree is not larger than 1.2 (NO at S35), the process illuminates only the second LED 24 counted from the rightmost one in step 37 (S37). That is, if "1.1<agreement degree K≦1.2", only the second LED 24 counted from the rightmost one is illuminated. Then, the process returns to the sewing routine.

If the agreement degree K is not larger than 0.9 (NO at S34), the process determines whether the agreement degree K is equal to or larger than 0.8 in step 38 (S38). If the agreement degree K is equal to or larger than 0.8 (YES at S38), the process illuminates only the second LED 22 counted from the leftmost one in step 39 (S39). That is, if "0.8≦agreement degree K<0.9", only the second LED 22 counted from the leftmost one is illuminated. On the other hand, if the agreement degree K is less than 0.8 (NO at S38), only the leftmost LED 21 is illuminated in step 40 (S40). That is, if "agreement degree K<0.8", only the leftmost LED 21 is illuminated. Then, the process returns to the sewing routine.

Figure 6:
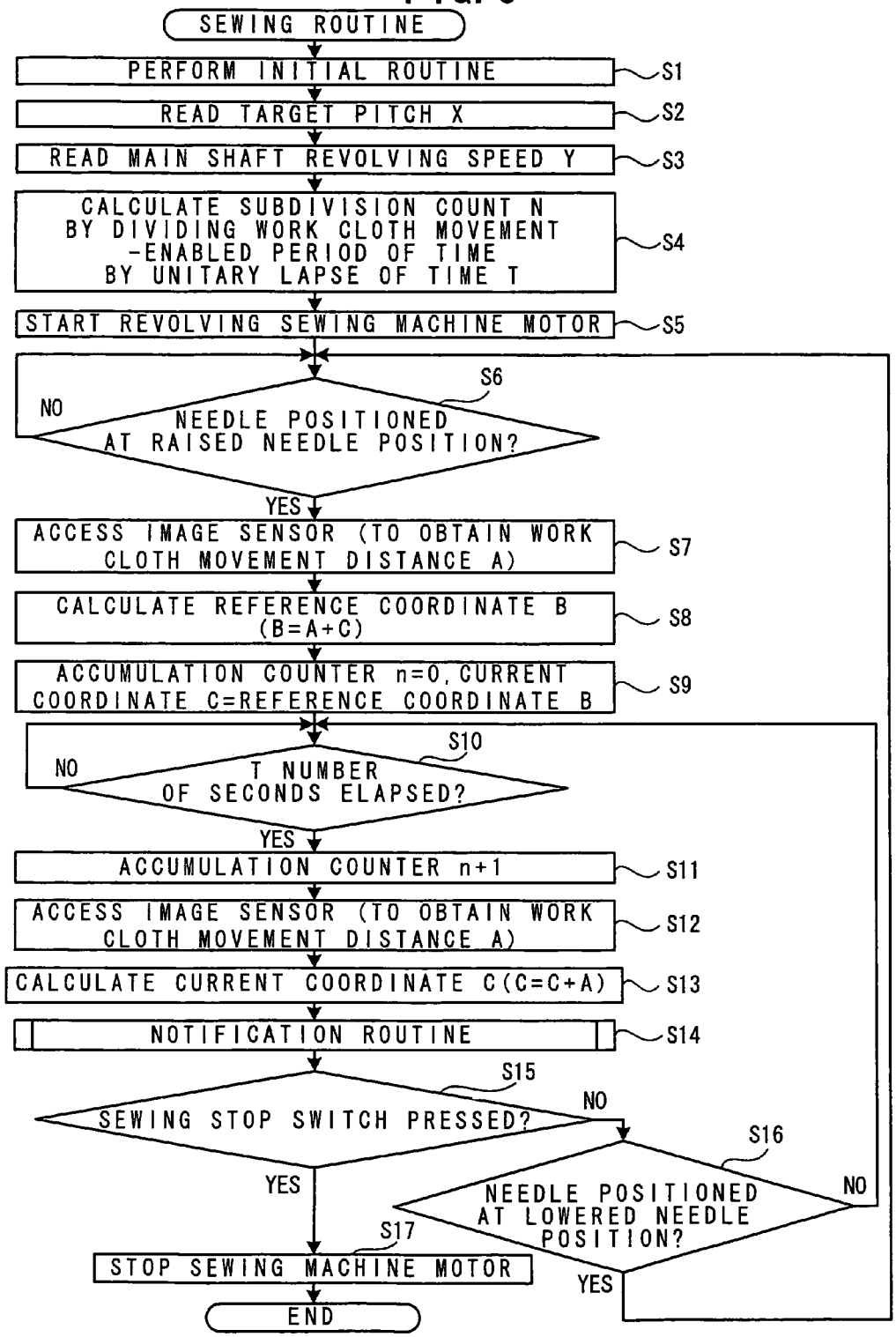
FIG. 6 is a flowchart of a sewing routine of a first example.

Subsequently, in the sewing routine, as shown in FIG. 6, the process determines whether the sewing stop switch 82 is pressed in step 15 (S15). If the sewing stop switch 82 is not pressed (NO at S15), the process determines whether the sewing needle 7 is at the lowered needle position based on the output of the lowered-needle-position sensor 89 in step 16 (S16). If not having determined that the sewing needle 7 is at the lowered needle position (NO at S16), the process returns to S10 to wait until the unitary lapse of time T (s) elapses (NO at S110 S10). If T number of seconds elapses (YES at S10), the process calculates an agreement degree and notifies of the agreement degree (S11 through S14). Then, if the sewing stop switch 82 is not pressed (NO at S15), the process determines the output of the lowered-needle-position sensor 89 (S16). If it reaches the lowered needle position while the processing of S10 through S16 is repeated (YES at S16), the process returns to S6 to wait until the sewing needle 7 reaches the raised needle position (NO at S16→S6). On the other hand, if the sewing stop switch 82 is pressed (YES at S15), the process stops the revolving of the sewing machine motor 79 in step 17 (S17) and the sewing routine is ended. In such a manner, the processing of S6 through S16 is repeated until the sewing stop switch 82 is pressed (YES at S15).

As described above, during a period of time when sewing is carried out; the agreement degree of the target pitch X of a currently forming stitch can be visually observed by a user over a short interval of the unitary lapse of time T. That is, a sewing operator can know, for each predetermined small lapse of time during a period of time when one stitch is being formed, the degree of agreement between a movement distance of the piece of work cloth accumulated after the start of the formation of the stitch and a target movement distance by which the piece of work cloth is moved during that lapse of time in a case where the stitches having a target pitch are formed. Therefore, the user can know in detail the agreement degree of a stitch even during the formation of that stitch, thereby making it easier to create uniform stitch pitches. Thus, if the middle LED 23 is illuminated, the user can recognize that stitches have successfully been formed at almost the same pitch as the target pitch X and thus may continue sewing. If the rightward LEDs 24 and 25 are illuminated, the user can recognize that the actual pitch of the stitches exceed the target pitch X and thus may decrease the feed for the piece of work cloth in order to realize the target pitch X in subsequent sewing. If the leftward LEDs 21 and 22 are illuminated, the user can recognize that the actual pitch of stitches come short of the target pitch X and thus may increase the feed for the piece of work cloth to realize the target pitch X in the subsequent sewing. By thus using the LEDs, the agreement degree can be visually observed by the sewing operator so that the user may easily recognize the agreement degree. Furthermore, because the LEDs are equipped below the head portion 5 of the sewing machine 1, they come in sight of the sewing operator so that the user can recognize the agreement degree even almost without moving his line of sight from the needle below him during sewing. In addition, the employment of the LEDs enables simplifying the construction and reducing the cost of display.

Figure 8:
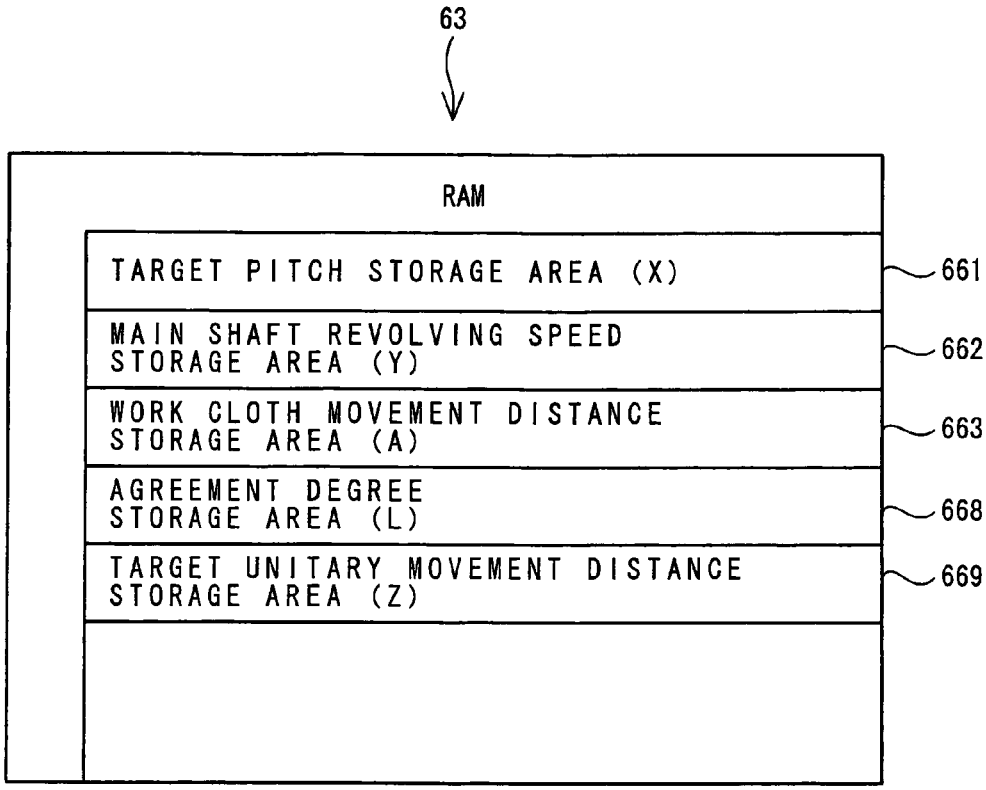
FIG. 8 is a conceptual diagram showing storage areas of the RAM according to a second example.
Figure 9:
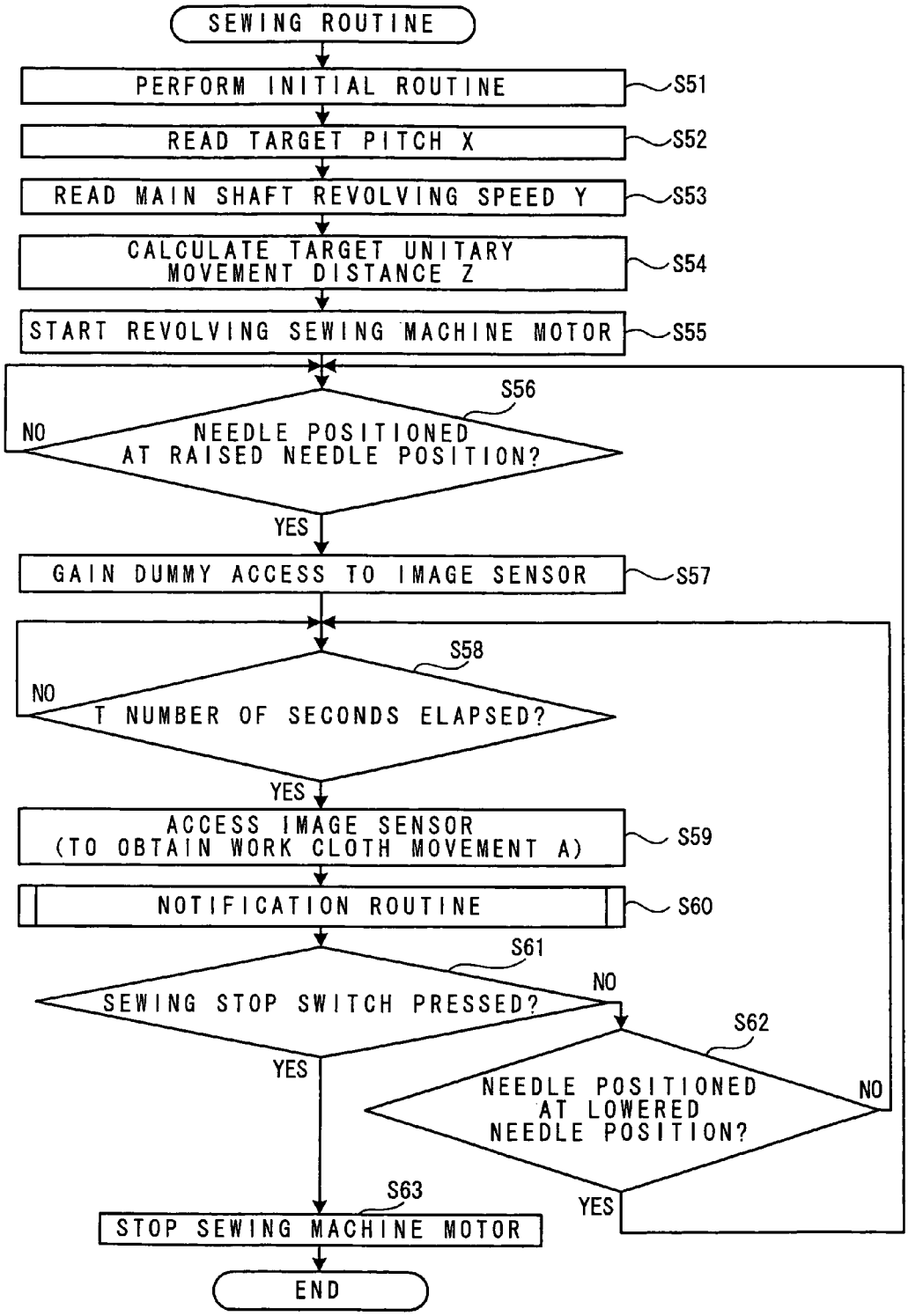
FIG. 9 is a flowchart of the sewing routine of the second example.
Figure 10:
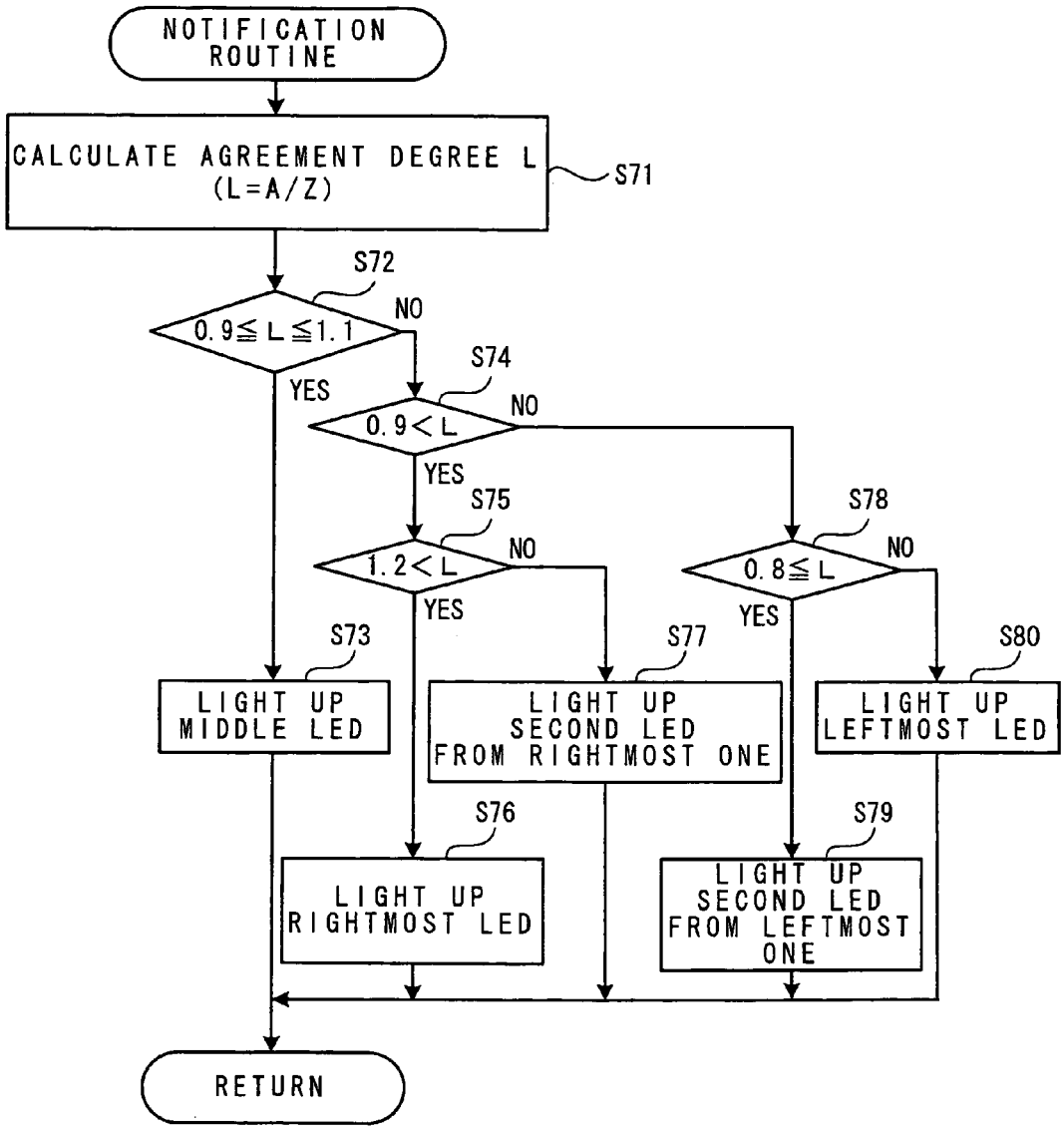
FIG. 10 is a flowchart of the notification routine that is performed in the sewing routine.

The following will describe the second example with reference to FIGS. 8 to 10.

First, storage areas provided to the RAM 63 will be described below with reference to FIG. 8. As shown in FIG. 5, the RAM 63 has a target pitch storage area 661, a main shaft revolving speed storage area 662, a work cloth movement distance storage area 663, an agreement degree storage area 668, a target unitary movement distance storage area 669, and the like. It should be noted that the RAM 63 may also have other storage areas than those illustrated. Because the target pitch storage area 661, the main shaft revolving speed storage area 662, and the work cloth movement distance storage area 663, are already described in the first example a detailed description thereof is omitted here.

The agreement degree storage area 668 stores an agreement degree L that indicates the degree of agreement between a target pitch and a pitch of stitches that are actually sewn. In the present second example, the movement distance (work cloth movement distance A) of a piece of work cloth is detected in each unitary lapse of time. On the other hand, in order to form stitches at a target pitch, a target movement distance in a unitary lapse of time (target unitary movement distance Z) is calculated. This distance indicates how much the piece of work cloth must be moved in the unitary lapse of time. Then, for each unitary lapse of time, the work cloth movement distance A and the target unitary movement distance Z are compared to each other, thereby the agreement degree L is calculated. In the present second example, the ratio of the work cloth movement distance A with respect to the target unitary movement distance Z is defined as the agreement degree L. That is, "agreement degree L=work cloth movement distance A/target unitary movement distance Z". The target unitary movement distance area 669 stores the target unitary movement distance Z.

Next, the operations of a sewing machine 1 in the second example will be described below with reference to the flowcharts of FIGS. 9 and 10. A sewing routine is performed when a sewing start switch 81 is pressed to cause the CPU 61 to execute a sewing program stored in the ROM 62.

First, the process performs an initial routine in step 51 (S51). In this initial routine, the process initializes the work cloth movement distance storage area 663, the agreement degree storage area 668, and the target unitary movement distance storage area 669 of the RAM 63 so that they may store initial value "0". Subsequently, the process reads a target pitch X from the target pitch storage area 661 of the RAM 63 in step 52 (S52), and reads the main shaft revolving speed Y from the main shaft revolving speed storage area 662 of the RAM 63 in step 53 (S53). Next, the process calculates a distance by which the piece of work cloth is to be moved in the unitary lapse of time T during a work cloth movement-enabled period of time Q, which is the target unitary movement distance Z, and stores it in the target unitary movement distance storage area 669 in step 54 (S54). Because the work cloth movement-enabled period of time Q is already described in the first example, a detailed description thereof is omitted here.

Then, a sewing machine motor 79 starts revolving in step 55 (S55). The process waits until a sewing needle 7 reaches its raised needle position (NO at S56→S56). Specifically, the process determines whether the sewing needle 7 is at the raised needle position based on the output of a raised-needle-position sensor 88 in step 56 (S56). If it is determined that the sewing needle 7 is not at the raised needle position (NO at S56), the process repeats determination of the output of the raised-needle-position sensor 88 (S56).

If it is determined that the sewing needle 7 has reached the raised needle position (YES at S56), the sewing needle 7 is pulled out of the piece of work cloth to start the formation of stitches. Therefore, the process accesses an image sensor 50 in step 57 (S57). This is a dummy access to cause the image sensor 50 to pick up the image of the piece of work cloth at a point in time of the start of sewing so that a work cloth movement distance A in the unitary lapse of time T may be obtained after the unitary lapse of time T elapses. Therefore, it is not necessary to store the obtained work cloth movement distance A in the work cloth movement distance storage area 663.

Then, in step 58 (S58), the process refers the current time to the RTC 69 and waits until the unitary lapse of time T elapses (NO at S58→S58). If the unitary lapse of time T elapses (YES at S58), the process accesses the image sensor 50 to acquire a work cloth movement distance A (XA, YA) and stores it in the work cloth movement distance storage area 663 in step 59 (S59). The work cloth movement distance A corresponds to an actual unitary movement distance. Then, in step 60 (S60), a notification routine is carried out (see S60 in FIG. 10). In this notification routine, the process calculates an agreement degree L, and based on it, illuminates an agreement degree notification LED 20.

In the notification routine, as shown in FIG. 10, the process first calculates an agreement degree L in step 71 (S71). The agreement degree L is calculated by calculating "actual work cloth movement distance A/target unitary movement distance Z". Because the relation of "target pitch X: work cloth movement-enabled period of time Q=target unitary movement distance Z: unitary lapse of time T" is established, the target unitary movement distance Z is calculated as "target pitch X*unitary lapse of time T/work cloth movement-enabled period of time Q". Further, as described above, "work cloth movement-enabled period of time Q=(60/main shaft revolving speed Y)/2", so that the target unitary movement distance Z is calculated as "target unitary movement distance Z=target pitch X*main shaft revolving speed Y*unitary time T/30)". Therefore, the agreement degree L is calculated as "agreement degree L=work cloth movement distance A/(target pitch X*main shaft revolving speed Y*unitary time T/30". That is, the closer the agreement degree L is to 1.0, the more the target pitch is approached and the smaller the difference therefrom. Further, the smaller the agreement degree L is, the less the target pitch is approached and the smaller the movement distance of the piece of work cloth is; and the larger the agreement degree L is, the more the target pitch is exceeded and the larger the movement distance of the piece of work cloth is.

In accordance with the value of the agreement degree L, the process performs lighting up of the agreement degree notification LED 20 in step 72 through step 80 (S72 through S80). First, the process determines whether the agreement degree L is in the range between 0.9 and 1.1 in step 72 (S72). If the agreement degree L is in this range (YES at S72), it means that the difference from the target pitch is small, so that the process illuminates only the middle LED 23 in step 73 (S73). That is, if "0.9≦agreement degree L≦1.1", only the middle LED 23 is illuminated. Then, the process returns to the sewing routine.

If the agreement degree L is not in the range between 0.9 and 1.1 (NO at S72), the process determines whether the agreement degree L is larger than 0.9 in step 74 (S74). If the agreement degree L is larger than 0.9 (YES at S74), the process further determines whether the agreement degree L is larger than 1.2 in step 75 (S75). If the agreement degree L is larger than 1.2 (YES at S75), the process illuminates only the rightmost LED 25 in step 76 (S76). That is, if "1.2<agreement degree L", only the rightmost LED 25 is illuminated. Then, the process returns to the sewing routine. On the other hand, if the agreement degree is not larger than 1.2 (NO at S75), the process illuminates only the second LED 24 counted from the rightmost one in step 77 (S77). That is, if "1.1<agreement degree L≦1.2", only the second LED 24 counted from the rightmost one is illuminated. Then, the process returns to the sewing routine.

If the agreement degree L is not larger than 0.9 (NO at S74), the process determines whether the agreement degree L is equal to or larger than 0.8 in step 78 (S78). If the agreement degree L is at least 0.8 (YES at S78), the process illuminates only the second LED 22 counted from the leftmost one in step 79 (S79). That is, if "0.8≦agreement degree L<0.9", only the second LED 22 counted from the leftmost one is illuminated. On the other hand, if the agreement degree L is less than 0.8 (NO at S78), only the leftmost LED 21 is illuminated in step 80 (S80). That is, if "agreement degree L<0.8", only the leftmost LED 21 is illuminated. Then, the process returns to the sewing routine.

Subsequently, in the sewing routine, as shown in FIG. 9, the process determines whether the sewing stop switch 82 is pressed in step 61 (S61). If the sewing stop switch 82 is not pressed (NO at S61), the process determines whether the sewing needle 7 is at the lowered needle position based on the output of a lowered-needle-position sensor 89 in step 62 (S62). If it is determined that the sewing needle 7 is not at the lowered needle position (NO at S62), the process returns to S58 to wait until the unitary lapse of time T (s) elapses (NO at S58→S58). If T number of seconds elapses (YES at S58), the process calculates an agreement degree and notifies of the agreement degree (S59, S60). Then, if the sewing stop switch is not pressed (NO at S61), the process determines the output of the lowered-needle-position sensor 89 (S62). If the needle position reaches the lowered needle position while the processing of S58 through S62 is repeated (YES at S62), the process returns to S56 to wait until the sewing needle 7 reaches its raised needle position (NO at S56→S56). On the other hand, if the sewing stop switch 82 is pressed (YES at S61), the process stops the revolving of the sewing machine motor 79 in step 63 (S63) and the sewing routine is ended. In such a manner, the processing of S6 through S16 is repeated until the sewing stop switch 82 is pressed (YES at S61).

As described above, during a period of time when sewing is carried out, the agreement degree of the target pitch X can be visually observed by a user over a short interval of the unitary lapse of time T. That is, a sewing operator can know, for each predetermined small lapse of time during a period of time when one stitch is being formed, the degree of agreement between a distance by which the piece of work cloth is moved in the predetermined small lapse of time and a target movement distance by which the piece of work cloth is moved during the predetermined small lapse of time in a case where the stitches having a target pitch are formed and thus can figure out in detail the degree of agreement, thereby making it easier to create uniform stitch pitches. Thus, if the LED 23, which is in the middle is illuminated, the user can recognize that stitches have successfully been formed at almost the same pitch as the target pitch and thus may continue sewing. If the LEDs 24 and 25 on the right side are illuminated, the user can recognize that the actual stitches exceed the target pitch X and thus may decrease the feed for the piece of work cloth to realize the target pitch X in the subsequent sewing. If the LEDs 21 and 22 on the left side are illuminated, the user can recognize that the actual stitches come short of the target pitch X and thus may increase the feed for the piece of work cloth to realize the target pitch X in subsequent sewing.

Figure 11:
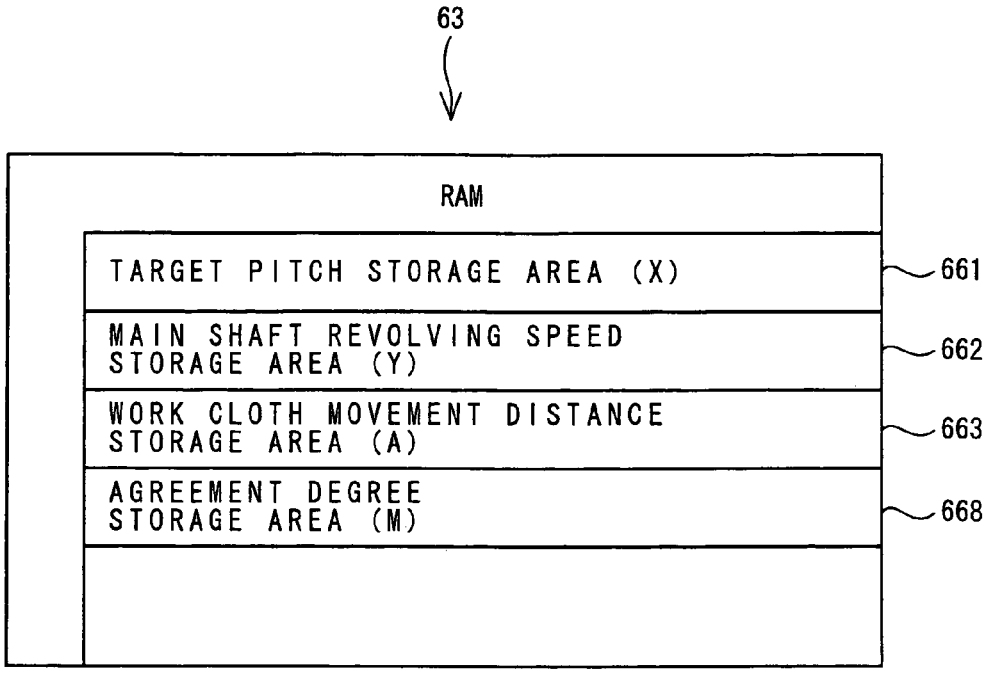
FIG. 11 is a conceptual diagram showing storage areas of the RAM according to a third example.
Figure 12:
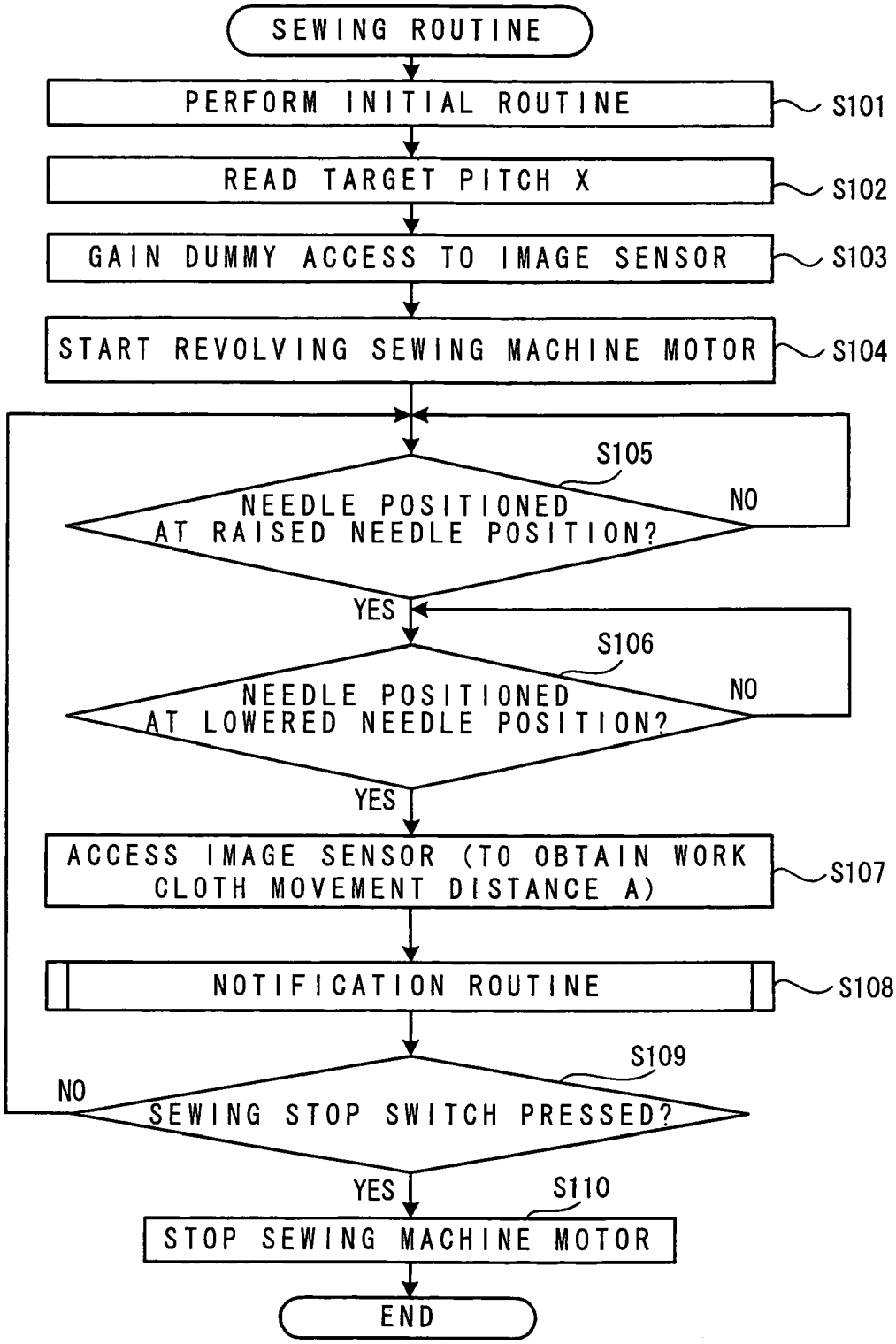
FIG. 12 is a flowchart of the sewing routine of the third example.
Figure 13:
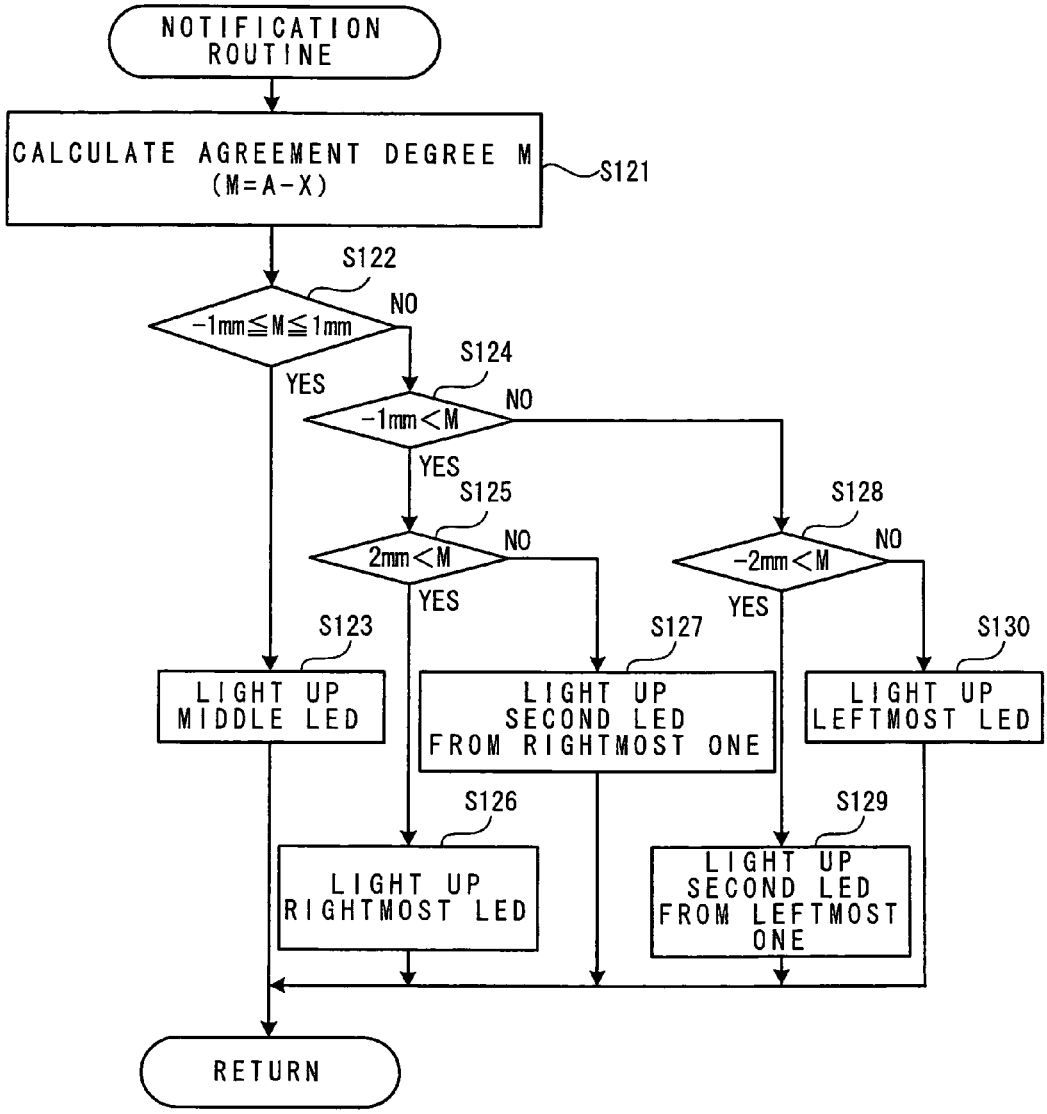
FIG. 13 is a flowchart of the notification routine that is performed in the sewing routine.

The following will describe the third example with reference to FIGS. 11 to 13.

First, storage areas provided to the RAM 63 will be described below with reference to FIG. 11. As shown in FIG. 15, the RAM 63 has a target pitch storage area 661, a main shaft revolving speed storage area 662, a work cloth movement distance storage area 663, an agreement degree storage area 668, and the like. It should be noted that the RAM 63 may also have other storage areas than those illustrated. Because the target pitch storage area 661, the main shaft revolving speed storage area 662, and the work cloth movement distance storage area 663 are already described in the first example, a detailed description thereof is omitted here.

The agreement degree storage area 668 stores an agreement degree M that indicates the degree of agreement between a target pitch and a pitch of stitches that are actually sewn. In the present third example, each time a sewing needle 7 moves from a lowered needle position to a raised needle position and then moves back to the lowered needle position again to thereby form one stitch, that is, for each stitch that the sewing needle 7 drops, the movement distance of a piece of work cloth is detected (work cloth movement distance A). That is, the work cloth movement distance A indicates the pitch of the stitches actually formed. Each time one stitch is formed, a work cloth movement distance A is compared to a target pitch X to calculate the agreement degree M. In the present third example, a difference between the work cloth movement distance A and the target pitch X is defined as the agreement degree M. That is, "agreement degree M=work cloth movement distance A−target pitch X".

Next, the operations of a sewing machine 1 in the third example will be described below with reference to the flowcharts of FIGS. 12 and 13. A sewing routine is performed when a sewing start switch 81 is pressed to cause a CPU 61 to execute a sewing program stored in the ROM 62.

First, the process performs an initial routine in step 101 (S101). In this initial routine, the process initializes the work cloth movement distance storage area 663 and the agreement degree storage area 668 of the RAM 63 so that they may store initial value "0". Subsequently, the process reads a target pitch X from the target pitch storage area 661 of the RAM 63 in step 102 (S102) and accesses an image sensor 50 in step 103 (S103). This is a dummy access to cause the image sensor 50 to pick up the image of the piece of work cloth at a point in time of the start of sewing so that a work cloth movement distance A in the unitary lapse of time T may be obtained after the unitary lapse of time T elapses. Therefore, it is not necessary to store the obtained work cloth movement distance A into the work cloth movement distance storage area 663.

Then, a sewing machine motor 79 starts revolving in step 104 (S104). In step 105 (S105), the process waits until the sewing needle 7 reaches the raised needle position (NO at S105→S105). Specifically, the process determines whether the sewing needle 7 is at the raised needle position based on the output of a raised-needle-position sensor 88 (S105). If it is determined that it is not at the raised needle position (NO at S105), the process repeats determination of the output of the raised-needle-position sensor 88 (S105).

If it is determined that the sewing needle 7 has reached the raised needle position (YES at S105), in step 106 (S106) the process waits until the sewing needle 7 reaches the lowered needle position (NO at S106→S106). Specifically, the process determines whether the sewing needle 7 is at the lowered needle position based on the output of a lowered-needle-position sensor 89 (S106). If it is determined that it is not at the lowered needle position (NO at S106), the process repeats determination of the output of the raised-needle-position sensor 88 (S106). If the sewing needle 7 has reached the lowered needle position (YES at S106), the process accesses the image sensor 50 to acquire a work cloth movement distance A (XA, YA) and stores it into the work cloth movement distance storage area 663 in step 107 (S107). Then, in step 108 (S108) the process performs a notification routine (see S108 in FIG. 13). In the notification processing, the process calculates the agreement degree M, and based on it, illuminates an agreement notification LED 20.

In the notification routine, as shown in FIG. 13, the process first calculates an agreement degree M in step 121 (S121). This agreement degree M is calculated by calculating "actual work cloth movement distance A−target pitch X". That is, the closer to 0 the agreement degree M is, the smaller a difference therefrom. Further, if the agreement degree M is a negative value, it indicates that the actual stitches come short of the target pitch X and the movement distance of the piece of work cloth is small; and if the agreement degree M is a positive value, it indicates that the actual stitches exceed the target pitch X and the movement distance of the piece of work cloth is large.

In accordance with the value of the agreement degree M, the process performs processing to illuminate the agreement degree notification LED 20 in steps 122 through 130 (S122 through S130). First, the process determines whether the agreement degree M is in the range between −1 mm and 1 mm (S122). If the agreement degree M is in this range (YES at S122), it means that the difference from the target pitch is small, so that the process illuminates only the LED 23, which is in the middle, in step 123 (S123). That is, if "−1 mm≦agreement degree M≦1 mm", only the middle LED 23 is illuminated. Then, the process returns to the sewing routine.

If the agreement degree M is not in the range between −1 mm and 1 mm (NO at S122), the process determines whether it is larger than −1 mm in step 124 (S124). If the agreement degree M is larger than −1 mm (YES at S124), the process further determines whether the agreement degree M is larger than 2 mm in step 125 (S125). If it is larger than 2 mm (YES at S125), the process illuminates only the rightmost LED 25 in step 126 (S126). That is, if "2 mm<agreement degree M", only the rightmost LED 25 is illuminated. Then, the process returns to the sewing routine. On the other hand, if the agreement degree M is not larger than 2 mm (NO at S125), the process illuminates only the second LED 24 counted from the rightmost one in step 127 (S127). That is, if "1 mm<agreement degree M≦2 mm", only the second LED 24 counted from the rightmost one is illuminated. Then, the process returns to the sewing routine.

If the agreement degree M is not larger than −1 mm (NO at S124), the process determines whether the agreement degree M is larger than −2 mm in step 128 (S128). If the agreement degree M is larger than −2 mm (YES at S128), the process illuminates only the second LED 22 counted from the leftmost one in step 129 (S129). That is, if "−2 mm≦agreement degree M<−1 mm", only the second LED 22 counted from the leftmost one is illuminated. On the other hand, if the agreement degree M is not larger than −2 mm (NO at S128), only the leftmost LED 21 is illuminated in step 130 (S130). That is, if "agreement degree M<−2 mm", only the leftmost LED 21 is illuminated. Then, the process returns to the sewing routine.

Subsequently, in the sewing routine, as shown in FIG. 12, the process determines whether the sewing stop switch 82 is pressed in step 109 (S109). If the sewing stop switch 82 is not pressed (NO at S109), the process returns to S105. On the other hand, if the sewing stop switch 82 is pressed (YES at S1109), the process stops the revolution of the sewing machine motor 79 in step 110 (S110) and ends the sewing routine. In such a manner, until the sewing stop switch 82 is pressed (YES at S109), the processing of S105 through S109 is repeated.

As described above, during a period of time when sewing is carried out, each time a stitch is formed, the agreement degree of the target pitch can be visually observed by a user. In such a manner, the agreement degree can be calculated with simple control, so that if the middle LED 23 is illuminated, the user can recognize that stitches have successfully been formed at almost the same pitch as the target pitch and thus may continue sewing. If the rightward LEDs 24 and 25 are illuminated, the user can recognize that the stitches exceed the target pitch X and thus may decrease the feed for the piece of work cloth to realize the target pitch. If the leftward LEDs 21 and 22 are illuminated, the user can recognize that the stitches come short of the target pitch X and thus may increase the feed for the piece of work cloth in order to realize the target pitch.

Of course, the sewing machine 1 in the present disclosure is not limited to the above-described first through third examples and it can be modified variously without departing the scope of the present disclosure. Although the first example has defined the ratio of an actual movement distance with respect to a target movement distance as an agreement degree K, the definition of the agreement degree K is not limited thereto. For example, it may be defined as a difference between an actual movement distance and a target movement distance. Although the second example has defined the ratio of a work cloth movement distance A with respect to a target unitary movement distance Z as an agreement degree L, the definition of the agreement degree L is not limited thereto. For example, it may be defined as a difference between the work cloth movement distance A and the target unitary movement distance Z. Although the third example has defined a difference between as work cloth movement distance A and a target pitch X as an agreement degree M, the definition of the agreement degree M is not limited thereto. For example, it may be defined as the ratio of the work cloth movement distance A with respect to the target pitch X. Further, the combination of the percentage of an agreement degree and the display modes of the display device is not limited to the present examples either.

Figure 14:
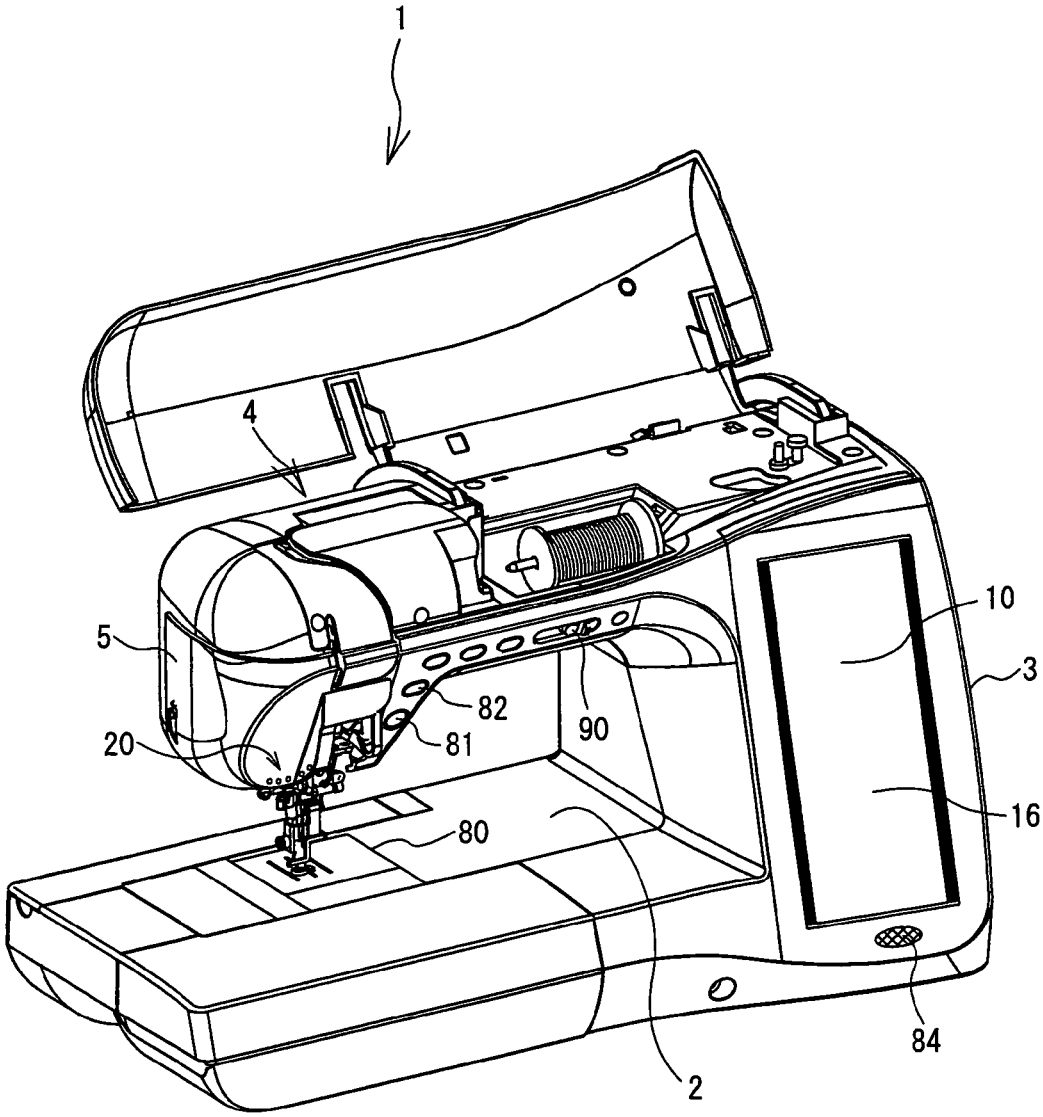
FIG. 14 is a perspective view of a sewing machine according to an alternative example.

Further, the configuration of the agreement degree notification LED 20 is not limited to that of using the five LEDs 21 to 25 as shown in FIG. 2. The number of LEDs used may be less than or more than five. Further, such a scheme may be employed so that the LED may not be illuminated if the agreement degree is acceptable or that the LED may blink if the agreement degree is lowered. Further, such LEDs may be used to have various different colors. Further, the notification device may not be an LED but it may be a light emitting member such as a lamp, a small-sized LCD, or an organic EL. Further, a message or the like may be displayed using the LCD 10 equipped to the pillar 3. Further, instead of visually observed by the user's eye, a speaker 84 may be equipped to the sewing machine 1 to give a voice message or warning beep in notification as shown in FIG. 14. Thus, even during sewing, the sewing operator can hear the beep or the voice and can recognize the degree of agreement even without taking the operator's eyes off the needle below him/her. It should be noted that the speaker 84 may be connected to an interface 66.

Although in the above examples, the user has entered the target pitch, it may be stored in the ROM 62 beforehand. In this case, the target pitch is read from the ROM 62 at S2 (FIG. 5), S52 (FIG. 8), and S101 (FIG. 10) of the sewing routine, respectively. Further, instead of reading the target pitch from a memory device such as the ROM 62 or the RAM 63, the value of the target pitch may be written in the sewing machine control program.

In the sewing machine in the present disclosure, as described above, the sewing operator may be notified of the degree of agreement between a target pitch and a pitch of stitches actually formed in sewing and thus can perform sewing while recognizing a difference from the target pitch. Therefore, if the agreement degree is lowered, the sewing operator can adjust to the target pitch by controlling a sewing speed or a feed for a piece of work cloth, and thereby sophisticated free motion sewing with uniform sewing pitches can be performed.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a main shaft that drives a needle bar that is configured to hold a sewing needle;

a sewing machine motor that rotary-drives the main shaft;

a detection device that detects an actual movement distance of a piece of work cloth;

a target pitch storage device that stores a predetermined length as a target pitch, is the target pitch being a target value of stitch pitches of the piece of work cloth;

an agreement degree calculation device that calculates an agreement degree between the target pitch and a stitch pitch in actual sewing that is to be determined based on the actual movement distance of the piece of work cloth, which is detected by the detection device; and a notification device that notifies of the agreement degree calculated by the agreement degree calculation device, wherein:

the detection device detects the actual movement distance of the piece of work cloth for each of a predetermined small lapse of time during a stitch formation period of time in which a needle drop point is formed next to a predetermined needle drop point; and the agreement degree calculation device calculates the agreement degree between:

an accumulated value obtained by accumulating the actual movement distance of the piece of work cloth for each of the predetermined small lapse of time detected by the detection device during a predetermined lapse of time in the stitch formation period of time, and an accumulated value obtained by accumulating a target movement distance of the piece of work cloth for each of the predetermined small lapse of time which is computed based on the target pitch and a revolving speed of the main shaft during the predetermined lapse of time in the stitch formation period of time.

2. The sewing machine according to claim 1, wherein the agreement degree is calculated based on at least one of a ratio and difference between:

the accumulated value obtained by accumulating the actual movement distance of the piece of work cloth, and the accumulated value obtained by accumulating the target movement distance of the piece of work cloth.

3. A sewing machine comprising:

a main shaft that drives a needle bar that is configured to hold a sewing needle;

a sewing machine motor that rotary-drives the main shaft;

a detection device that detects an actual movement distance of a piece of work cloth;

a target pitch storage device that stores a predetermined length as a target pitch, is the target pitch being a target value of stitch pitches of the piece of work cloth;

an agreement degree calculation device that calculates an agreement degree between the target pitch and a stitch pitch in actual sewing that is to be determined based on the actual movement distance of the piece of work cloth, which is detected by the detection device; and a notification device that notifies of the agreement degree calculated by the agreement degree calculation device, wherein:

the detection device detects the actual movement distance of the piece of work cloth for each of a predetermined small lapse of time during a stitch formation period of time in which a needle drop point is formed next to a predetermined needle drop point; and the agreement degree calculation device calculates the agreement degree between:

the actual movement distance detected by the detection device and a target movement distance for each of the predetermined small lapse of time which is computed based on the target pitch and a revolving speed of the main shaft.

4. The sewing machine according to claim 3, wherein the agreement degree is calculated based on at least one of a ratio and difference between:

the actual movement distance detected by the detection device, and the target movement distance for each of the predetermined small lapse of time which is computed.

5. A sewing machine comprising:

a main shaft that drives a needle bar that is configured to hold a sewing needle;

a sewing machine motor that rotary-drives the main shaft;

a detection device that detects an actual movement distance of a piece of work cloth;

a target pitch storage device that stores a predetermined length as a target pitch, is the target pitch being a target value of stitch pitches of the piece of work cloth;

an agreement degree calculation device that calculates an agreement degree between the target pitch and a stitch pitch in actual sewing that is to be determined based on the actual movement distance of the piece of work cloth, which is detected by the detection device; and a notification device that notifies of the agreement degree calculated by the agreement degree calculation device, wherein:

the detection device detects the actual movement distance of the piece of work cloth for each stitch with which the sewing needle drops; and the agreement degree calculation device calculates the agreement degree between:

the actual movement distance detected by the detection device, and the length of the target pitch.

6. The sewing machine according to claim 5, wherein the agreement degree is calculated based on at least one of a ratio and difference between:

the actual movement distance detected by the detection device, and the length of the target pitch.

7. The sewing machine according to claim 1, wherein the notification device is a display device displaying a visual indicator that corresponds to the agreement degree.

8. The sewing machine according to claim 7, wherein the display device is provided on a lower part of a front surface of a head portion of the sewing machine.

9. The sewing machine according to claim 7, wherein the display device is constituted of at least one LED.

10. The sewing machine according to claim 1, wherein the notification device is an audio output device outputting at least one of a sound and voice which corresponds to the agreement degree.

11. A non-transitory computer-readable recording medium storing a sewing machine control program which controls a sewing machine, the program comprising:

a detection instruction for detecting an actual movement distance of a piece of work cloth;

a target pitch storage instruction for storing a predetermined length as a target pitch, which is a target value of stitch pitches of the piece of work cloth;

an agreement degree calculation instruction for calculating an agreement degree between the target pitch and a stitch pitch in actual sewing that is to be determined based on the actual movement distance of the piece of work cloth which is detected by the detection instruction; and a notification instruction for notifying of the agreement degree calculated by the agreement degree calculation instruction, wherein:

the detection instruction detects the actual movement distance of the piece of work cloth for each of a predetermined small lapse of time during a stitch formation period of time in which a needle drop point is formed next to a predetermined needle drop point; and the agreement degree calculation instruction calculates the agreement degree between:

an accumulated value obtained by accumulating the actual movement distance of the piece of work cloth for each of the predetermined small lapse of time detected by the detection instruction during a predetermined lapse of time in the stitch formation period of time, and an accumulated value obtained by accumulating a target movement distance of the piece of work cloth for each of the predetermined small lapse of time which is computed based on the target pitch and a revolving speed of a main shaft of a motor of the sewing machine during the predetermined lapse of time in the stitch formation period of time.

12. The recording medium according to claim 11, wherein the agreement degree is calculated based on at least of a ratio and difference between:

the accumulated value obtained by accumulating the actual movement distance of the piece of work cloth, and the accumulated value obtained by accumulating the target movement distance of the piece of work cloth.

13. A non-transitory computer-readable recording medium storing a sewing machine control program which controls a sewing machine, the program comprising:

a detection instruction for detecting an actual movement distance of a piece of work cloth;

a target pitch storage instruction for storing a predetermined length as a target pitch, which is a target value of stitch pitches of the piece of work cloth;

an agreement degree calculation instruction for calculating an agreement degree between the target pitch and a stitch pitch in actual sewing that is to be determined based on the actual movement distance of the piece of work cloth which is detected by the detection instruction; and a notification instruction for notifying of the agreement degree calculated by the agreement degree calculation instruction, wherein:

the detection instruction detects the actual movement distance of the piece of work cloth for each of a predetermined small lapse of time during a stitch formation period of time in which a needle drop point is formed next to a predetermined needle drop point; and the agreement degree calculation instruction calculates the agreement degree between:

the actual movement distance detected by the detection instruction, and a target movement distance for each of the predetermined small lapse of time which is computed based on the target pitch and a revolving speed of a main shaft of a motor of the sewing machine.

14. The recording medium according to claim 13, wherein the agreement degree is calculated based on at least one of a ratio and difference between:

the actual movement distance detected by the detection instruction and the target movement distance for each of the predetermined small lapse of time which is computed.

15. A non-transitory computer-readable recording medium storing a sewing machine control program which controls a sewing machine, the program comprising:

a detection instruction for detecting an actual movement distance of a piece of work cloth;

a target pitch storage instruction for storing a predetermined length as a target pitch, which is a target value of stitch pitches of the piece of work cloth;

an agreement degree calculation instruction for calculating an agreement degree between the target pitch and a stitch pitch in actual sewing that is to be determined based on the actual movement distance of the piece of work cloth which is detected by the detection instruction; and a notification instruction for notifying of the agreement degree calculated by the agreement degree calculation instruction, wherein:

the detection instruction detects the actual movement distance of the piece of work cloth for each stitch with which the sewing needle drops; and the agreement degree calculation instruction calculates the agreement degree between:

the actual movement distance detected by the detection instruction, and the length of the target pitch.

16. The recording medium according to claim 15, wherein the agreement degree is calculated based on at least one of a ratio and difference between:

the actual movement distance detected by the detection instruction, and the length of the target pitch.

17. The recording medium according to claim 11, wherein the notification instruction is a display instruction for displaying an appearance which corresponds to the agreement degree.

18. The recording medium according to claim 11, wherein the notification instruction is an audio output instruction for outputting at least one of a sound and voice which corresponds to the agreement degree.

19. The sewing machine according to claim 3, wherein the notification device is a display device displaying a visual indicator that corresponds to the agreement degree.

20. The sewing machine according to claim 19, wherein the display device is provided on a lower part of a front surface of a head portion of the sewing machine.

21. The sewing machine according to claim 19, wherein the display device is constituted of at least one LED.

22. The sewing machine according to claim 3, wherein the notification device is an audio output device outputting at least one of a sound and voice which corresponds to the agreement degree.

23. The sewing machine according to claim 5, wherein the notification device is a display device displaying a visual indicator that corresponds to the agreement degree.

24. The sewing machine according to claim 23, wherein the display device is provided on a lower part of a front surface of a head portion of the sewing machine.

25. The sewing machine according to claim 23, wherein the display device is constituted of at least one LED.

26. The sewing machine according to claim 5, wherein the notification device is an audio output device outputting at least one of a sound and voice which corresponds to the agreement degree.

27. The recording medium according to claim 13, wherein the notification instruction is a display instruction for displaying an appearance which corresponds to the agreement degree.

28. The recording medium according to claim 13, wherein the notification instruction is an audio output instruction for outputting at least one of a sound and voice which corresponds to the agreement degree.

29. The recording medium according to claim 15, wherein the notification instruction is a display instruction for displaying an appearance which corresponds to the agreement degree.

30. The recording medium according to claim 15, wherein the notification instruction is an audio output instruction for outputting at least one of a sound and voice which corresponds to the agreement degree.

* * * * *